US007828699B2

(12) United States Patent
P'erez De Lazarraga

(10) Patent No.: US 7,828,699 B2
(45) Date of Patent: Nov. 9, 2010

(54) BASE FOR A TREADMILL

(76) Inventor: Pablo P'erez De Lazarraga, No. 139, Jhongshan Rd., Daya Hsiang, Taichung Hsien (TW)

( * ) Notice: Subject to any disclaimer, the term of this patent is extended or adjusted under 35 U.S.C. 154(b) by 0 days.

(21) Appl. No.: 12/319,254

(22) Filed: Jan. 5, 2009

(65) Prior Publication Data

US 2010/0173755 A1 Jul. 8, 2010

(51) Int. Cl.
*A63B 22/02* (2006.01)

(52) U.S. Cl. ..... 482/54

(58) Field of Classification Search ..... 482/51, 482/54, 69, 148; 119/700; D21/669
See application file for complete search history.

(56) References Cited

U.S. PATENT DOCUMENTS

| | | | | | |
|---|---|---|---|---|---|
| 5,088,729 | A * | 2/1992 | Dalebout | ..... | 482/54 |
| 5,474,510 | A * | 12/1995 | Chen | ..... | 482/54 |
| 5,476,430 | A * | 12/1995 | Lee et al. | ..... | 482/54 |
| 5,518,471 | A | 5/1996 | Hettinger | | |
| 5,529,553 | A | 6/1996 | Finlayson | | |
| 5,542,892 | A * | 8/1996 | Buhler | ..... | 482/54 |
| 5,964,681 | A * | 10/1999 | Stevens | ..... | 482/54 |
| 6,328,676 | B1 * | 12/2001 | Alessandri | ..... | 482/54 |
| 6,572,513 | B1 * | 6/2003 | Whan-Tong et al. | ..... | 482/54 |
| 6,623,407 | B2 * | 9/2003 | Novak et al. | ..... | 482/54 |
| 6,736,760 | B1 * | 5/2004 | Lee | ..... | 482/54 |
| 6,887,185 | B1 * | 5/2005 | Kuo | ..... | 482/54 |
| 6,945,913 | B2 * | 9/2005 | Moore et al. | ..... | 482/54 |
| 7,060,009 | B2 * | 6/2006 | Greenleaf | ..... | 482/61 |
| 7,156,777 | B2 * | 1/2007 | Dyer et al. | ..... | 482/54 |
| 2002/0183170 | A1 | 12/2002 | Wu | | |
| 2004/0152566 | A1 * | 8/2004 | Yeh | ..... | 482/54 |
| 2005/0148441 | A1 * | 7/2005 | Dyer et al. | ..... | 482/54 |

* cited by examiner

*Primary Examiner*—Loan Thanh
*Assistant Examiner*—Daniel F Roland
(74) *Attorney, Agent, or Firm*—Jackson Walker, LLP

(57) ABSTRACT

A base for a treadmill has a bottom board, two side frames and two stepping frames. The bottom board has two sides. The side frames are attached respectively to the sides of the bottom board, and each side-frame has a top. The stepping frames are connected respectively to the side frames, and each stepping frame has an anti-slipping frame and a side wing. The anti-slipping frame is mounted securely on the top of a corresponding side frame and has a top and an anti-slipping member mounted on the top of the anti-slipping frame. The side wing is connected to the anti-slipping frame and extends toward a side opposite to the bottom board. Accordingly, the base can fit with different running belts with different widths and is versatile and convenient in use.

3 Claims, 7 Drawing Sheets

BASE FOR A TREADMILL

BACKGROUND OF THE INVENTION

1. Field of the Invention

The present invention relates to a base, and more particularly to a base for a treadmill.

2. Description of Related Art

With reference to FIGS. 6 and 7, a treadmill comprises a base (40), a running belt (50) and a handle assembly. The running belt (50) is endlessly mounted around the base (40), and the handle assembly is mounted on one end of the base (40) and may be provided with a display and a controller. The base (40) comprises a bottom board (42), two side frames (44) and two anti-slipping straps (46). The running belt (50) is mounted endlessly around the bottom board (42). The side frames (44) are mounted respectively on two sides of the bottom board (42), The anti-slipping straps (46) are attached on the top of the bottom board (42) respectively near the sides of the bottom board (42).

However, the anti-slipping straps (46) are mounted on the top of the bottom board (42), areas on the top near two sides of the bottom board (42) have to be left for mounting the anti-slipping straps (46) so that the width of the running belt (50) is reduced and limited. In addition, the bottom board (42) is always metal to provide an enough supporting effect and bear the impact force while the treadmill is in use. To fit with a running belt (50) with a large width, the bottom board (42) has to be also enlarged, but this will increase the weight of and the cost for manufacturing the base (40). To transport and use of a treadmill with a heavy base (40) is inconvenient.

To overcome the shortcomings, the present invention tends to provide a base to mitigate or obviate the aforementioned problems.

SUMMARY OF THE INVENTION

The main objective of the invention is to provide a base for a treadmill and that can fit with different running belts with different widths and is versatile and convenient in use. The base has a bottom board, two side frames and two stepping frames. The bottom board has two sides. The side frames are attached respectively to the sides of the bottom board, and each side frame has a top. The stepping frames are connected respectively to the side frames, and each stepping frame has an anti-slipping frame and a side wing. The anti-slipping frame is mounted securely on the top of a corresponding side frame and has a top and an anti-slipping member mounted on the top of the anti-slipping frame. The side wing is connected to the anti-slipping frame and extends toward a side opposite to the bottom board.

Other objects, advantages and novel features of the invention will become more apparent from the following detailed description when taken in conjunction with the accompanying drawings.

DETAILED DESCRIPTION OF PREFERRED EMBODIMENT

Figure 1:
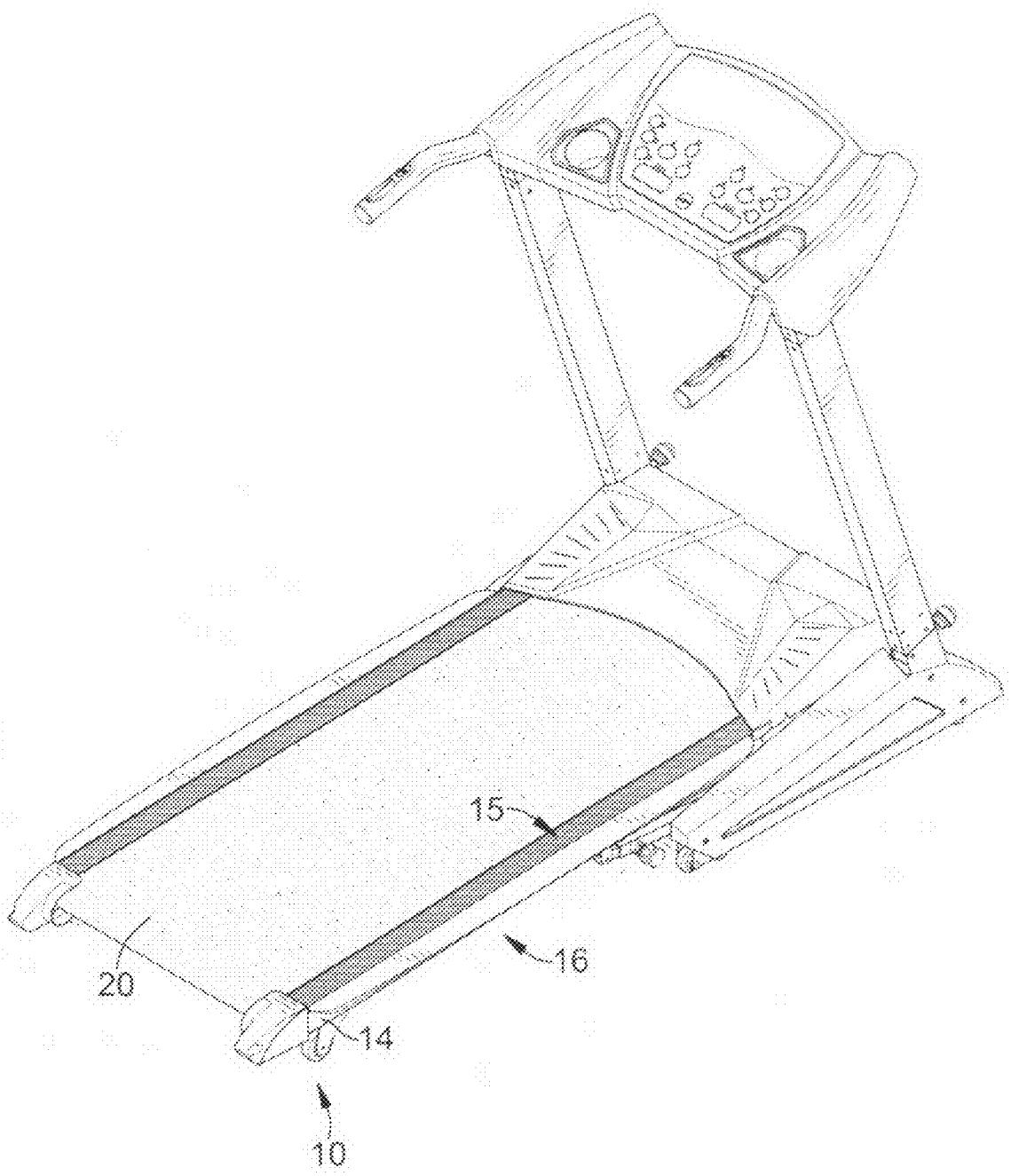
FIG. 1 is a perspective view of a treadmill with a base in accordance with the present invention.
Figure 2:
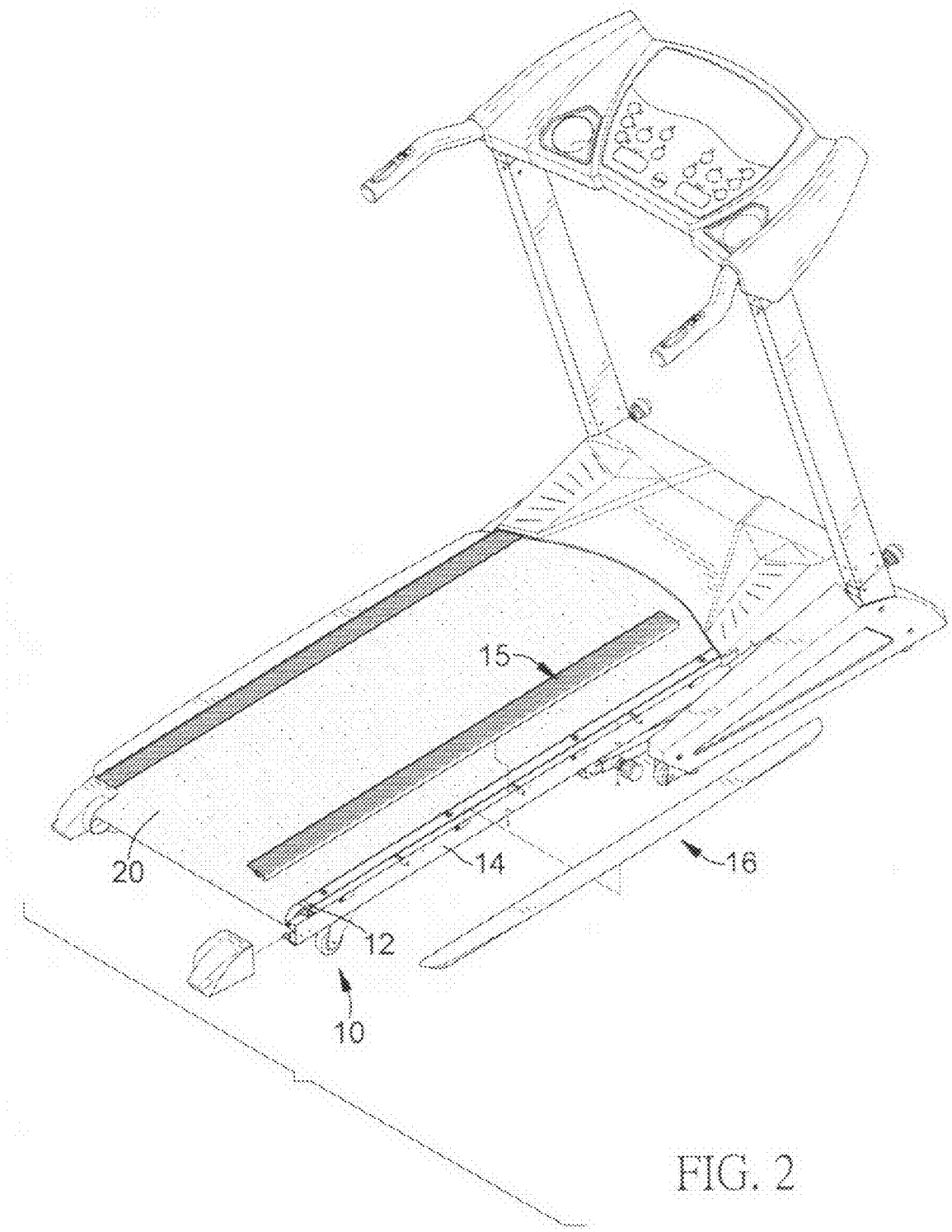
FIG. 2 is a partially exploded perspective view of the treadmill with the base in FIG. 1.
Figure 3:
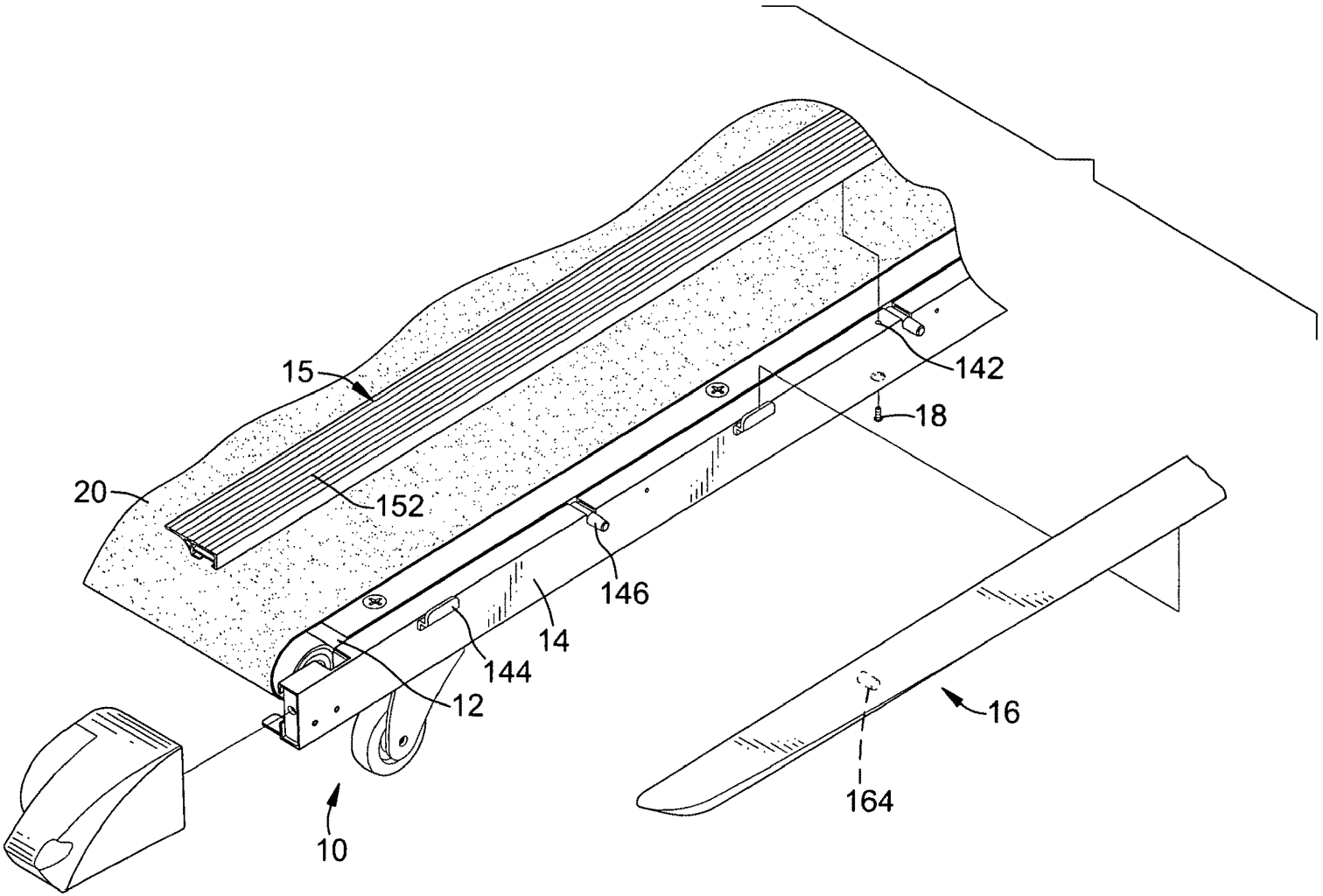
FIG. 3 is an enlarged exploded perspective view of the base in FIG. 1.

With reference to FIGS. 1 to 3, a base (10) for a treadmill in accordance with the present invention comprises a bottom board (12), two side frames (14) and two stepping frames. The bottom board (10) has two sides, and a running belt (20) is endlessly mounted around the bottom board (10). The side frames (14) are attached respectively to the sides of the bottom board (10), and each side frame (14) has a top.

The stepping frames are connected respectively to the side frames (14), and each stepping frame comprises an anti-slipping frame (15) and a side wing (16).

Figure 4:
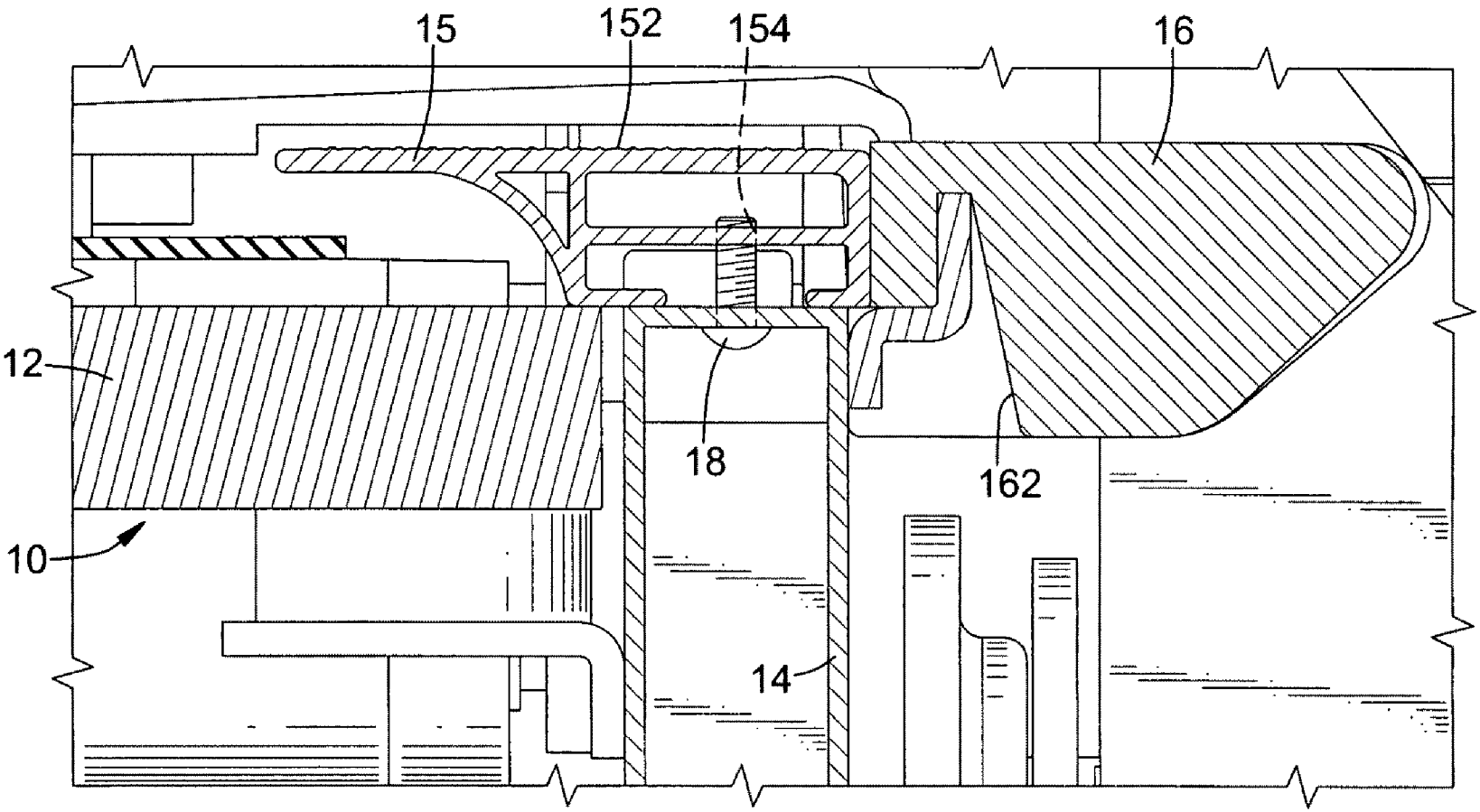
FIG. 4 is an enlarged end view in partial section of the treadmill with the base in FIG. 1.

With further reference to FIG. 4, the anti-slipping frame (15) is mounted securely on the top of a corresponding side frame (14). To securely mount the anti-slipping frames (15) on the side frames (14), each side frame (14) has multiple through holes (142). The anti-slipping frame (15) of each stepping frame has multiple threaded holes (154) defined in the bottom of the anti-slipping frame (15) and aligning respectively with the through holes (142) in the corresponding side frame (14). Multiple bolts (18) are mounted respectively through the through holes (142) in the side frames (14) and are screwed respectively into the threaded holes (154) in the anti-slipping frames (15). Accordingly, the anti-slipping frames (15) are securely mounted on the tops of the side frames (14) with the bolts (18).

The anti-slipping frame (15) has an anti-slipping member mounted on the top of the anti-slipping frame (15). The anti-slipping member on the anti-slipping frame (15) may comprise multiple anti-slipping ribs (152) formed on the top of the anti-slipping frame (15). In an alternative embodiment, with reference to FIG. 5, the anti-slipping member on the anti-slipping frame (15A) may comprise a strap (152A) securely attached to the top of the anti-slipping frame (15A) and having a top and multiple anti-slipping ribs formed on the top of the strap (152A).

In addition, the anti-slipping frame (15) may further have an extension segment formed on the top of the anti-slipping (15) and extending above the bottom board (12) and the running belt (20) to enlarge the area for stepping on the anti-slipping frame (15).

The side wing (16) is connected to the anti-slipping frame (15) and extends toward a side opposite to the bottom board (12).

In a preferred embodiment, the side wing (16) and the anti-slipping frame (15) are separate parts, and one side of the side wing (16) abuts with a corresponding side of the anti-slipping frame (15), and the side wing (16) is connected securely to the corresponding side frame (14). To connect the side wings (16) to the side frames (14), each side frame (14) has multiple holding elements mounted on a side of the side frame (14) opposite to the bottom board (12). Each side wing (16) has multiple engaging elements respectively engaging the holding elements on the corresponding side frame (14). The holding elements comprise multiple holding hooks (144) and holding rods (146) mounted on and protruding from the side of the side frame (14) opposite to the bottom board (12). The engaging elements on the side wings (16) comprise multiple engaging recesses (162) and engaging holes (164). The engaging recesses (162) are defined in the bottoms of the side wings (16) and respectively engage the holding hooks (144) on the side frames (14). The engaging holes (164) are defined in the sides of the side wings (16) and respectively engage the holding rods (146) on the side frames (14). With the engagements between the holding elements and the engaging elements, the side wings (16) are connected securely to the side frames (14).

Figure 5:
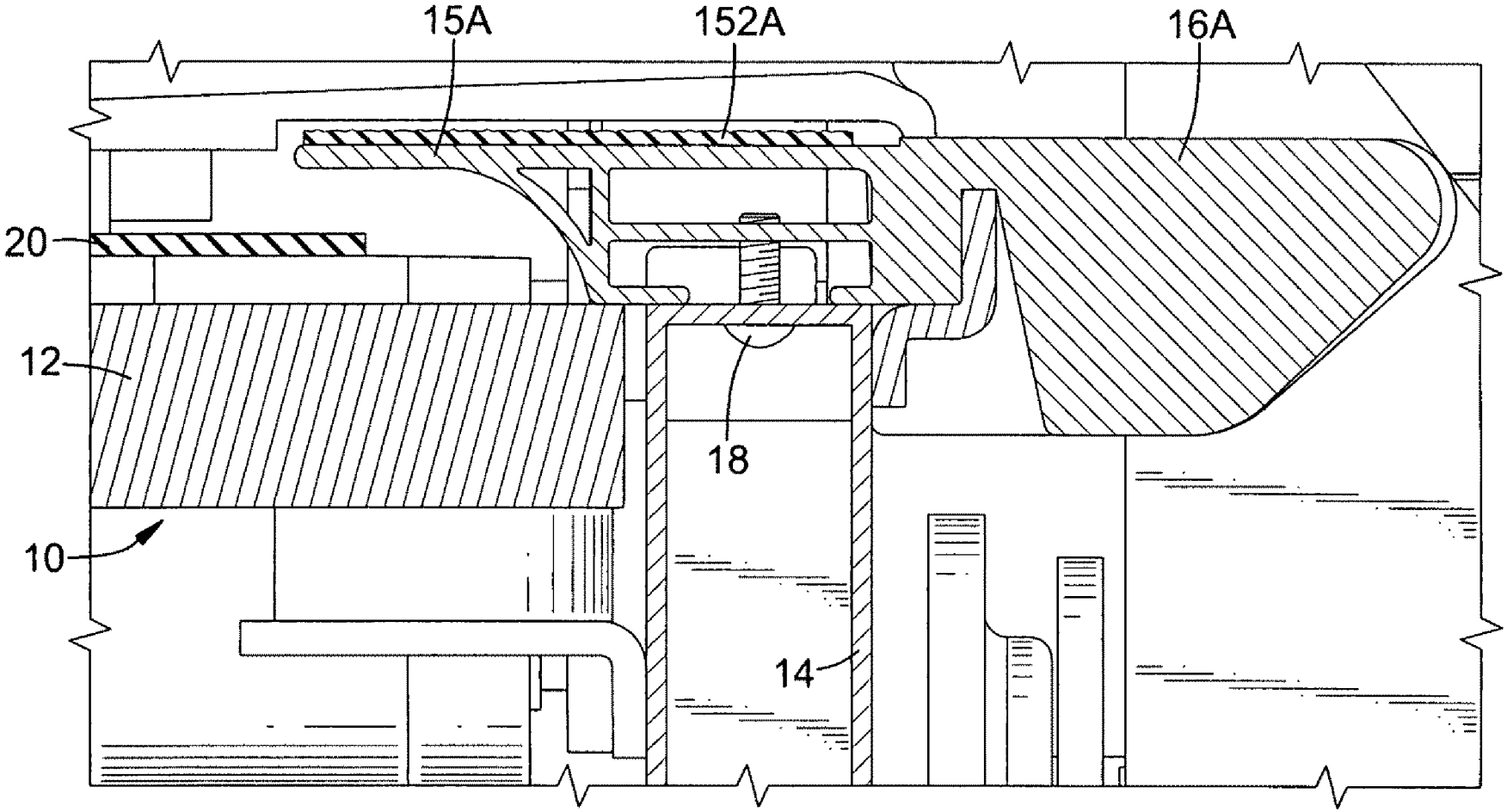
FIG. 5 is an end view in partial section of a treadmill with a base with another embodiment of a stepping frame in accordance with the present invention.
Figure 6:
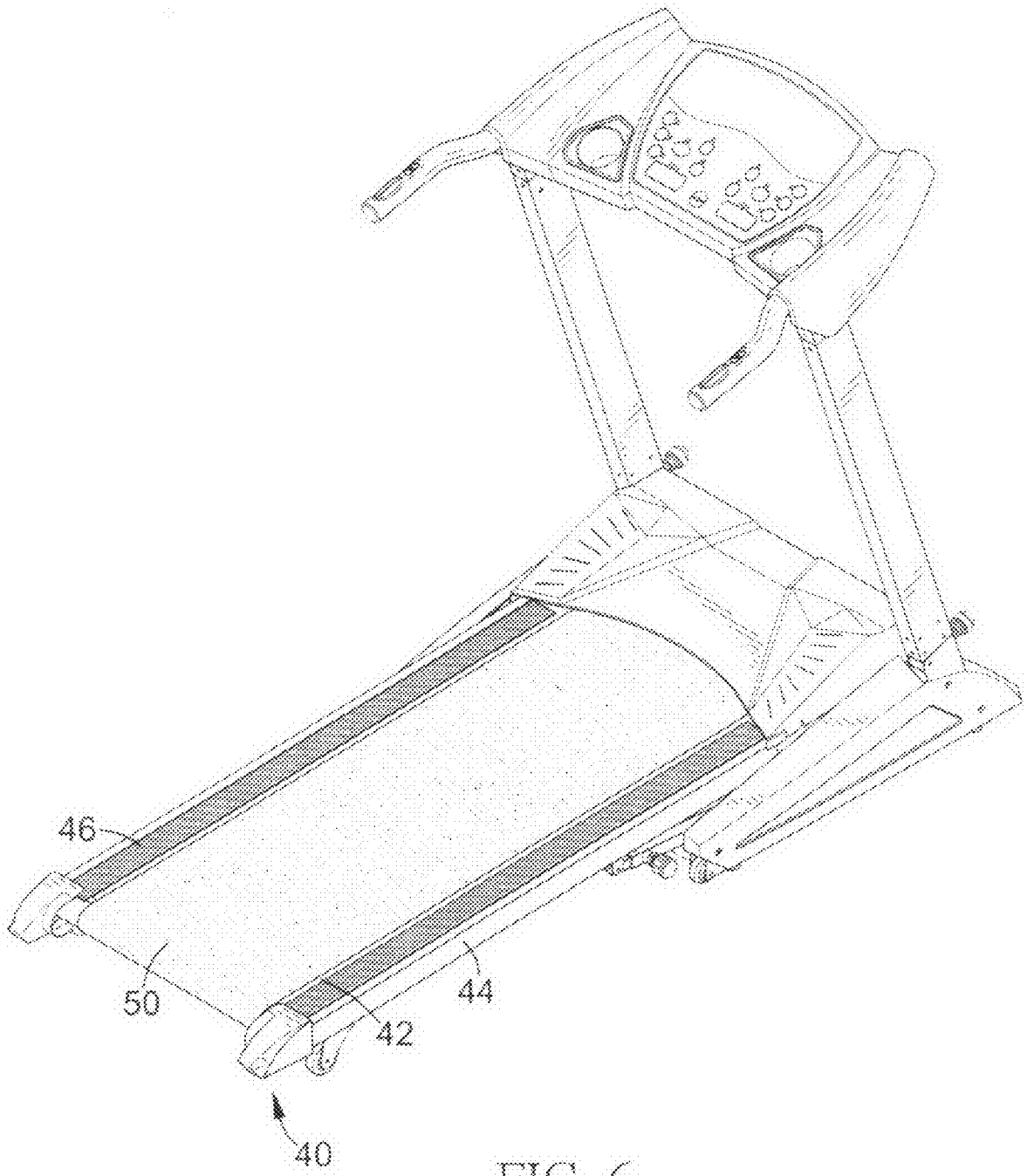
FIG. 6 PRIOR ART
FIG. 6 is a perspective view of a treadmill with a base in accordance with the prior art.
Figure 7:
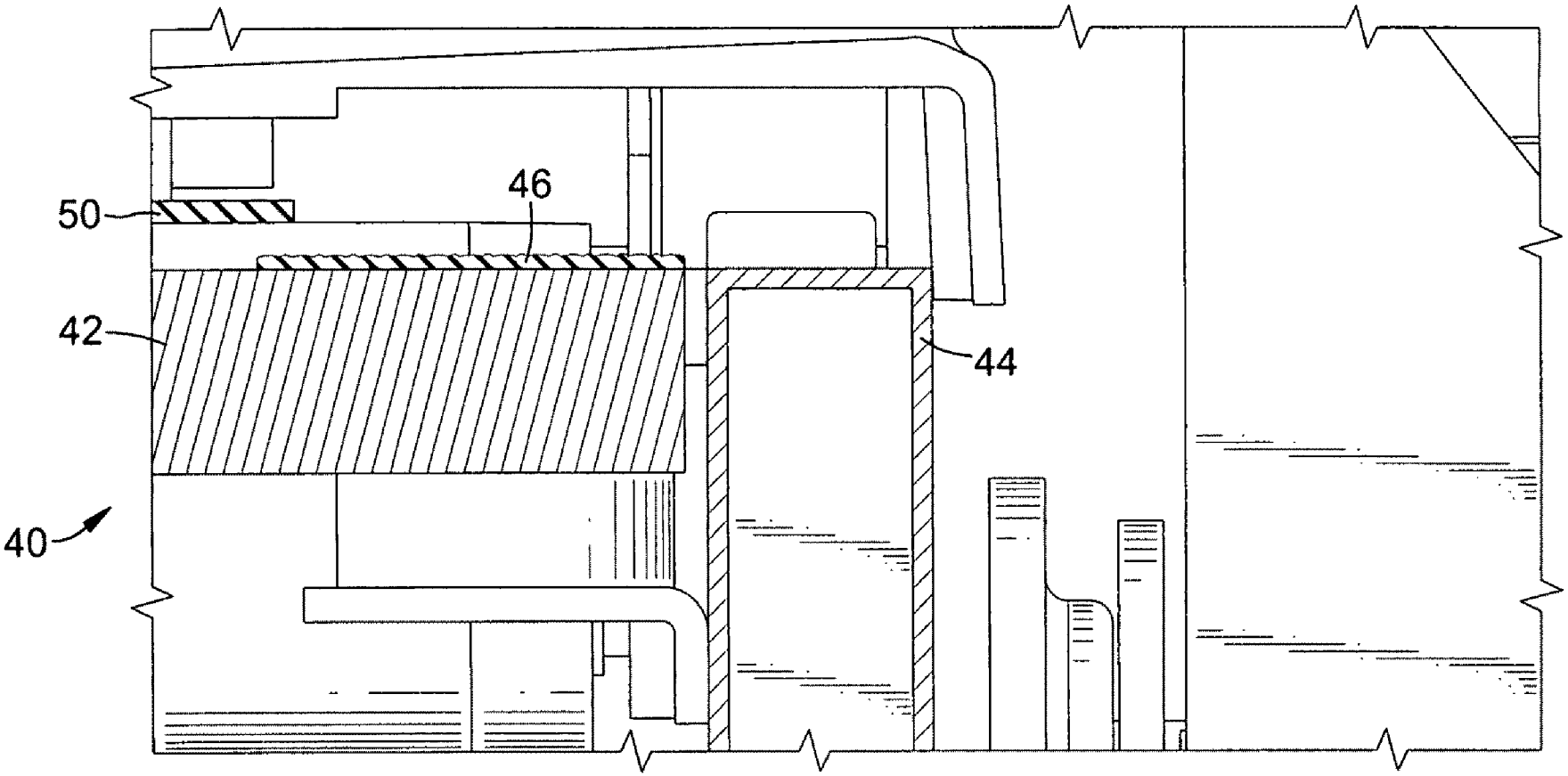
FIG. 7 PRIOR ART
FIG. 7 is an enlarged end view of the treadmill with the base in FIG. 6.

In an alternative embodiment as shown in FIG. 5, the side wing (16A) of each stepping frame is integrally formed on and protruding from the anti-slipping frame (15A) of the stepping frame.

With the anti-slipping members being mounted on the anti-slipping frames (15,15A) of the stepping frames, the bottom board (12) is kept free from the anti-slipping members and to leave areas for arranging the anti-slipping members on the bottom board (12) is unnecessary. Consequently, the width of the running belt (20) mounting around the bottom board (12) can be enlarged without enlarging the bottom board (12) simultaneously. Thus, the range of widths of running belts (20) being applied to a bottom board increases, and the base (10) for the treadmill is versatile in use.

Moreover, the stepping frames can be made of light materials, such as plastic steel, aluminum alloy or plastic different from that for the bottom board (12), the cost for manufacturing and weight of the base (10) can be reduced. To transport and use a treadmill with the base (10) in accordance with the present invention is convenient.

In addition, with the arrangements of the side wings (16, 16A) and the extension segments on the anti-slipping frames (15,15A), the areas of the stepping frames for users to step increase, so the safety of using the treadmill with a base (10) in accordance with the present invention is enhanced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A base for a treadmill comprising:

a bottom board having two sides;

two side frames attached respectively to the sides of the bottom board and each side frame having a top; and two stepping frames connected respectively to the side frames and each stepping frame comprising an anti-slipping frame having a bottom mounted securely on the top of a corresponding side frame, a top opposite to the bottom, a side between the top and the bottom of the anti-slipping frame and opposite to the bottom board and an anti-slipping member mounted on the top of the anti-slipping frame; and a side wing connected to the side of the anti-slipping frame and extending laterally toward a side opposite to the bottom board to increase areas of the stepping frames for users to step, wherein the anti-slipping member on the anti-slipping frame of each stepping frame comprises multiple anti-slipping ribs formed on the top of the anti-slipping frame;

each side frame has multiple through holes;

the anti-slipping frame of each stepping frame has multiple threaded holes defined in the bottom of the anti-slipping frame and aligning respectively with the through holes in the corresponding side frame;

multiple bolts mounted respectively through the through holes in the side frames and screwed respectively into the threaded holes in the anti-slipping frames;

the side wing of each stepping frame abuts with the anti-slipping frame of the stepping frame and is connected securely to the corresponding side frame;

each side frame has multiple holding elements mounted on a side of the side frame opposite to the bottom board; and the side wing of each stepping frame has multiple engaging elements respectively engaging the holding elements on the corresponding side frame.

2. The base as claimed in claim 1, wherein the holding elements on each side frame comprise multiple holding hooks mounted on the side of the side frame opposite to the bottom board; and the engaging elements on the side wing of each stepping frame comprise multiple engaging recesses defined in a bottom of the side wing and respectively engaging the holding hooks on the corresponding side frame.

3. The base as claimed in claim 1, wherein the holding elements on each side frame comprise multiple holding rods mounted on and protruding from the side of the side frame opposite to the bottom board; and the engaging elements on the side wing of each stepping frame comprise multiple engaging holes defined in a side of the side wing and respectively engaging the holding rods on the corresponding side frame.

* * * * *